United States Patent [19]

Santos, Sr.

[11] 4,408,127

[45] Oct. 4, 1983

[54] POWER GENERATING APPARATUS

[76] Inventor: Astrogildo Santos, Sr., 20301 Cantara St., Canoga Park, Calif. 91304

[21] Appl. No.: 377,950

[22] Filed: May 13, 1982

[51] Int. Cl.[3] ..... F03B 13/00

[52] U.S. Cl. ..... 290/54; 290/43

[58] Field of Search ..... 290/1, 52, 43, 54

[56] References Cited

U.S. PATENT DOCUMENTS 2,652,690 9/1953 Labriola et al. ..... 290/1 R 3,750,001 7/1973 McClosky ..... 290/52

FOREIGN PATENT DOCUMENTS 741639 2/1933 France ..... 290/1 R

*Primary Examiner*—J. V. Truhe

*Assistant Examiner*—Shelley Wade

*Attorney, Agent, or Firm*—Jack C. Munro

[57] ABSTRACT

A closed system power generating apparatus which utilizes a moving fluid as the work producing medium. The fluid is contained within a reservoir. A pump is utilized to move the fluid through a conduit assembly. The moved fluid drives a primary turbine which in turn produces electricity which is conducted to operate a load. The moved fluid is then conducted into contact with a secondary turbine which is used to drive an electrical generating device which supplies electrical energy to a circuit which is connected through a battery through the pump which produces movement of the fluid.

4 Claims, 1 Drawing Figure

POWER GENERATING APPARATUS

REFERENCE TO DISCLOSURE DOCUMENT

This invention was disclosed in Disclosure Document No. 090991, filed May 22, 1980.

BACKGROUND OF THE INVENTION

The field of this invention relates to power generating apparatuses and more particularly to a closed fluid conducting system wherein the fluid motion is utilized to produce energy output.

The use of power generating apparatuses has long been known. Use of a moving fluid to produce output energy has also long been known.

Most power generating apparatuses of the prior art are substantially large in size. Also, efficiency of most power generating apparatuses can be improved upon. There is a need to construct a physically compact power generating apparatus which produces energy most efficiently.

SUMMARY OF THE INVENTION

The power generating apparatus of this invention uses a fluid, such as a liquid (water) to be conducted through a conduit assembly to be discharged from a reservoir and then to be returned to the reservoir. Mounted within the conduit system is a pump which moves the liquid through the conduit system. Also located within the conduit system is a primary turbine. The moving liquid contacts the primary turbine and produces electrical energy which in turn is to be transmitted to operate a load. After leaving the primary turbine, the moving liquid is conducted through a bypass conduit to operate the secondary turbine. The secondary turbine, in turn, operates a power generating device, such as an alternator to produce electrical energy. The electrical energy is conducted through an electrical circuit which includes a battery which is electrically connected to operate the pump which is used to move the liquid through the conduit system. A manually operated switching apparatus is associated with the electrical circuit for the pump for the purpose of turning on and off the power generating apparatus of this invention.

DETAILED DESCRIPTION OF THE SHOWN EMBODIMENT

Figure 1:
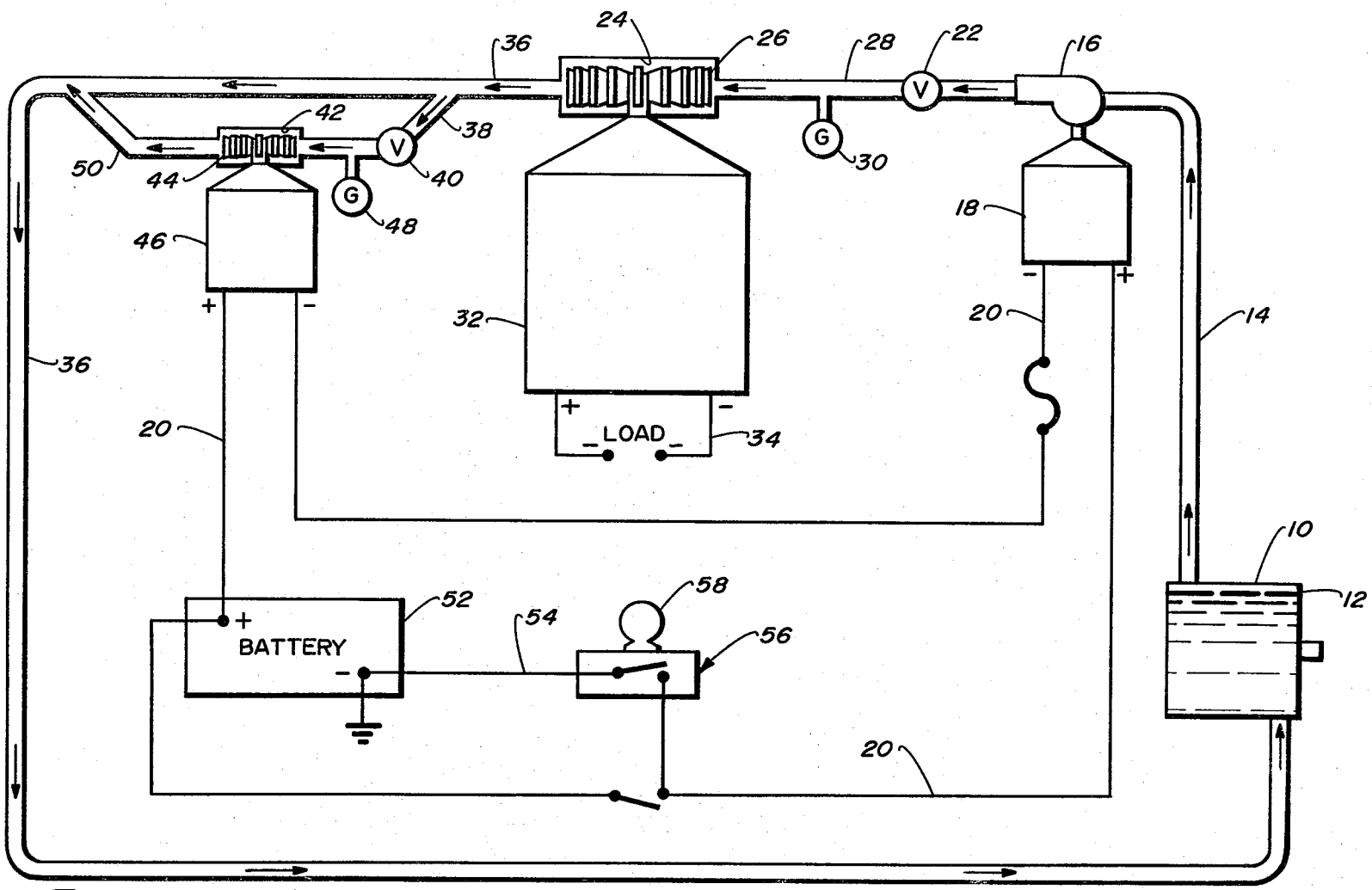
FIG. 1, is a diagramatic view showing the power generating apparatus of this invention.

Referring particularly to the drawing, there is shown a reservoir 10 within which is to be located a liquid 12. The liquid 12 is to be moved from the reservoir 10 into conduit 14. Conduit 14 is connected to impeller assembly 16 which is rotatably driven by means of a pump 18. Pump 18 is driven by electrical energy from circuit 20.

The liquid 12, after being discharged from the impeller assembly 16 is conducted through a valve 22 into a primary turbine chamber 24. Within the turbine chamber 24 is located a primary turbine blade assembly 26. A pressure gage is connected to the conduit 28 which interconnects with the primary turbine blade chamber 24 and the impeller assembly 16. The valve 22 is located within the conduit 28.

The purpose of the valve 22 is for adjusting the quantity of flow through the conduit 28. The pressure gage 30 is for determining the liquid pressure within the conduit 28. Normally it is desired that the pressure within the conduit 28 not exceed certain desired levels.

The primary turbine blade assembly 26 is connected in a conventional manner to an electrical generator structure which is mounted within housing 32. The electrical energy produced from the electrical generator within the housing 32 is conducted through circuit 34 to a load of some type. This load could be any type of structure which utilizes electrical energy.

The liquid from the primary turbine blade housing 24 is discharged into a conduit 36. A bypass conduit 38 is connected to the conduit 36. The bypass conduit 38 divides the flow of the liquid from the conduit 36 into two different channels. The flow of the liquid through the conduit 38 passes through a valve 40 into a secondary turbine blade chamber 42. Within the secondary turbine blade chamber 42 is located a secondary turbine blade assembly 44. The secondary turbine blade assembly 44 operates an electrical generator, such as an alternator, which is located in a alternator housing 46. Rotation of the secondary turbine blade assembly 44 produces electricity which is conducted into circuit 20.

A pressure gage 48 is connected to the conduit 38 to visually take a reading of the pressure of the liquid within the conduit 38. The higher the pressure read by the pressure gage 48, the greater amount of liquid being conducted into contact with the secondary turbine blade assembly 44. Operating of valve 40 is to vary the flow of the liquid through the conduit 38.

The liquid is discharged from the secondary turbine blade chamber 42 through conduit 50 back to conduit 36. The conduit 36 then conducts the liquid back into the reservoir 10.

The secondary circuit 20 includes a battery 52. The battery 52 is electrically connected through a key circuit 54 to a switching assembly 56. The switching assembly 56 is operated by means of manual operation of the key 58. Turning of the key 58 in one direction results in closing of the switching circuit 56 which results in electrical energy being conducted to the pump 18. Movement of the key 58 in the opposite direction will result in opening of the key circuit 56, which in turn does not permit the conducting of electrical energy to the pump 18.

In order to operate the power generating apparatus of this invention, the user is only required to manually turn key 58 so as to close the circuit 54. This results in electrical energy being conducted from the battery 52 to operate the pump 18. This, in turn, results in movement of the liquid from the reservoir 10 through conduit 14 and into conduit 28 and, hence, into contact with primary turbine blade assembly 26. As a result, electrical energy is produced which is then transmitted to the load through circuit 34. Continual movement of the liquid from the primary turbine blade assembly 26 results in operation of the secondary turbine blade assembly 44 producing some amount of electrical energy to recharge battery 52, as well as to assist in the operation of the pump 18. It is to be understood that the battery 52 will have to be periodically recharged as the amount of energy produced by the alternator assembly 46 is not sufficient to keep the battery 52 completely recharged as well as to operate pump 18.

What is claimed is:

1. A power generating apparatus comprising:

a closed fluid conducting conduit assembly;

a fluid reservoir connected to said conduit assembly, a fluid contained within said reservoir;

a pump connected to said conduit assembly, said pump to move said fluid through said conduit assembly, said pump being driven solely from energy from a first energy source;

a primary turbine rotatably driven by the movement of said fluid from said pump, said primary turbine producing primary output energy, a load receiving said primary output energy;

a secondary turbine connected in said conduit assembly, said secondary turbine being rotatably driven by the movement of the fluid from said primary turbine, said secondary turbine producing secondary output energy, said secondary turbine being located downstream of said primary turbine, said secondary output energy comprising in part said first energy source;

a battery, said battery being connected to and comprising in part said first energy source; and switching means manually connected to said first energy source for activating said pump.

2. The power generating apparatus as defined in claim 1 wherein:

said first energy source being electricity.

3. The power generating apparatus as defined in claim 2 wherein:

said switching means being manually operable.

4. The power generating apparatus as defined in claim 3 wherein:

said conduit assembly comprises a bypass conduit, said bypass conduit to provide a separate flow path for a portion of said fluid separate from said conduit assembly, said secondary turbine being connected to said bypass conduit.

* * * * *